US007325378B2

(12) United States Patent
Ausnit

(10) Patent No.: US 7,325,378 B2
(45) Date of Patent: Feb. 5, 2008

(54) VERTICAL FORM FILL AND SEAL METHOD FOR PRODUCING RECLOSABLE PACKAGES FROM TWO SHEETS OF WEB

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 64 days.

(21) Appl. No.: 11/080,771

(22) Filed: Mar. 15, 2005

(65) Prior Publication Data

US 2006/0207221 A1 Sep. 21, 2006

(51) Int. Cl.
*B65B 61/18* (2006.01)
*B65B 9/02* (2006.01)

(52) U.S. Cl. ..... 53/412; 53/451; 53/133.4; 53/139.2; 53/554; 493/213

(58) Field of Classification Search ..... 53/412, 53/451, 133.4, 139.4, 139.2, 553–555; 493/213
See application file for complete search history.

(56) References Cited

U.S. PATENT DOCUMENTS 3,339,337 A * 9/1967 Rapp et al. ..... 53/562
4,631,905 A * 12/1986 Maloney ..... 53/554
4,779,400 A * 10/1988 Hoskinson et al. ..... 53/451
4,909,017 A * 3/1990 McMahon et al. ..... 53/410
5,072,571 A * 12/1991 Boeckmann ..... 53/133.4
5,400,568 A * 3/1995 Kanemitsu et al. ..... 53/412
5,425,216 A * 6/1995 Ausnit ..... 53/410
5,519,982 A * 5/1996 Herber et al. ..... 53/412
5,813,197 A * 9/1998 Aguzzoli ..... 53/453
5,826,401 A * 10/1998 Bois ..... 53/412
6,030,122 A * 2/2000 Ramsey et al. ..... 383/61.2
6,088,998 A * 7/2000 Malin et al. ..... 53/416
6,212,857 B1 * 4/2001 Van Erden ..... 53/412
6,327,837 B1 * 12/2001 Van Erden ..... 53/412
6,810,641 B2 * 11/2004 Ausnit ..... 53/412
6,810,642 B2 * 11/2004 Cortigiano, Sr. ..... 52/412
6,986,237 B2 * 1/2006 Ausnit et al. ..... 53/412
2003/0177738 A1 * 9/2003 Plourde ..... 53/412

FOREIGN PATENT DOCUMENTS

FR 2579174 A1 * 9/1986

* cited by examiner

*Primary Examiner*—Stephen F. Gerrity
(74) *Attorney, Agent, or Firm*—Day Pitney LLP

(57) ABSTRACT

Various embodiments and alternatives for vertical form fill and seal methods and apparatus are disclosed. In particular, two sheets of web are fed by forming collars to a fill tube (or in some embodiments, side by side fill tubes) wherein the sheets of web are wrapped approximately 180 degrees around the periphery of the fill tube. Zippers can be provided mounted transversely on the first sheet of web, mounted in the machine direction on the first sheet of web, or fed as a continuous length between the two longitudinal edges of the two sheets of web. Additionally, some embodiments fill side by side bags from a single fill tube. Other embodiments fill side by side bags from side by side fill tubes.

20 Claims, 10 Drawing Sheets

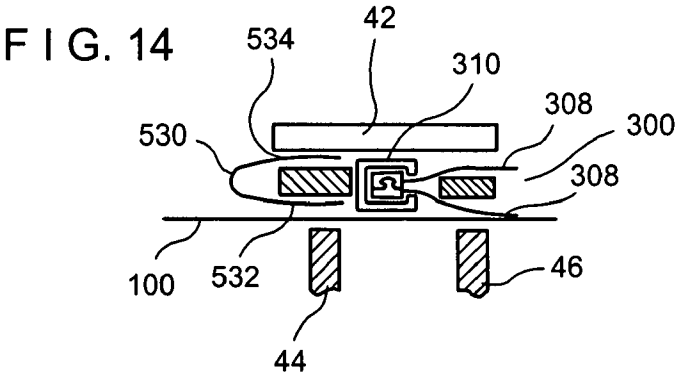
FIG. 14
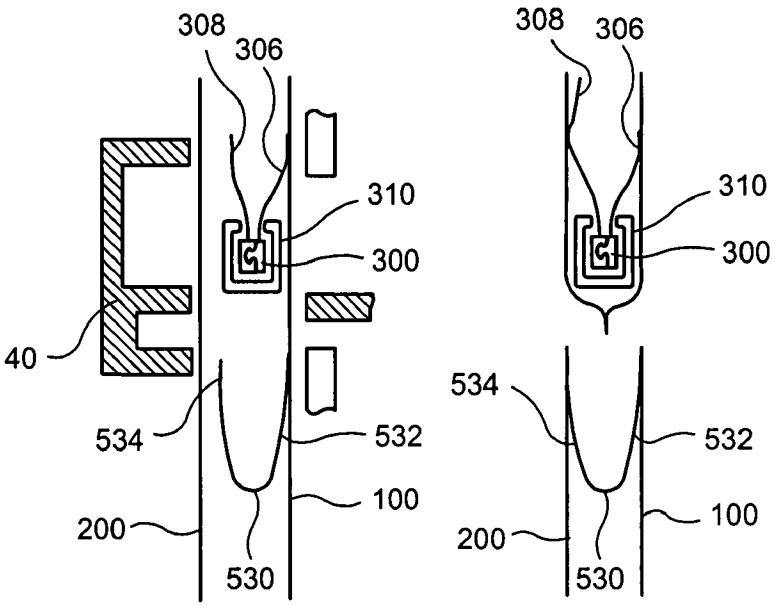
FIG. 16
FIG. 17
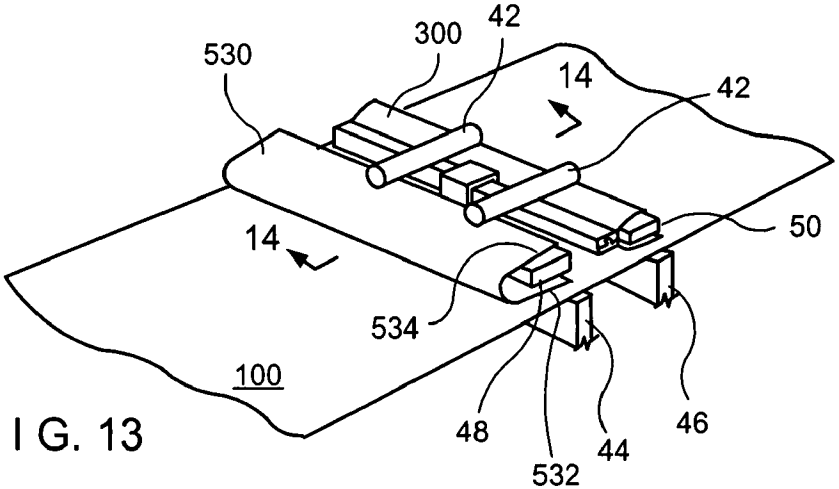
FIG. 13
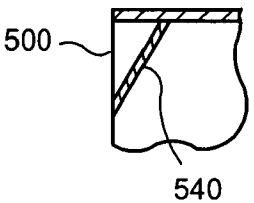
FIG. 18
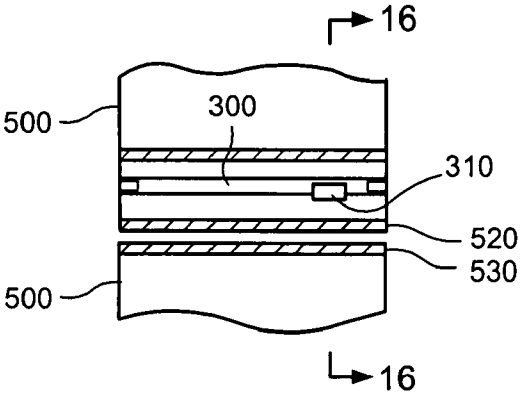
FIG. 15

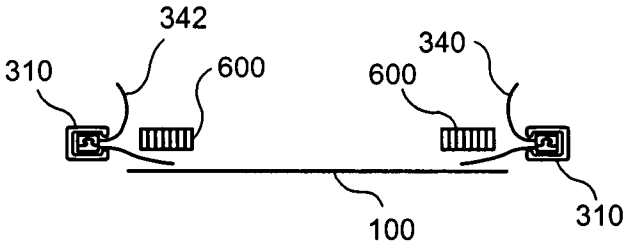
FIG. 26
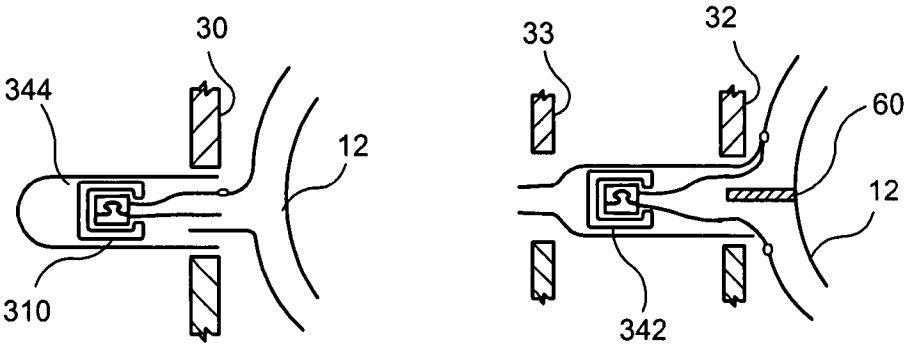
FIG. 29
FIG. 28
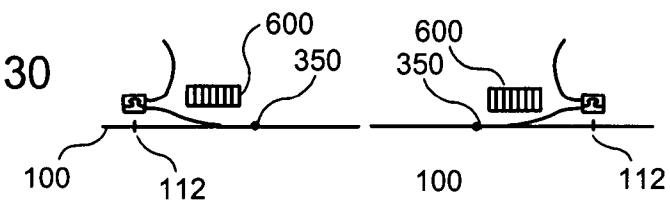
FIG. 30
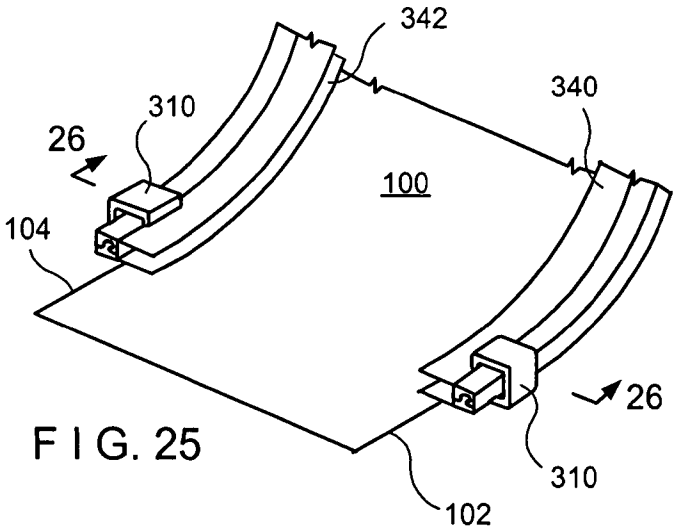
FIG. 25
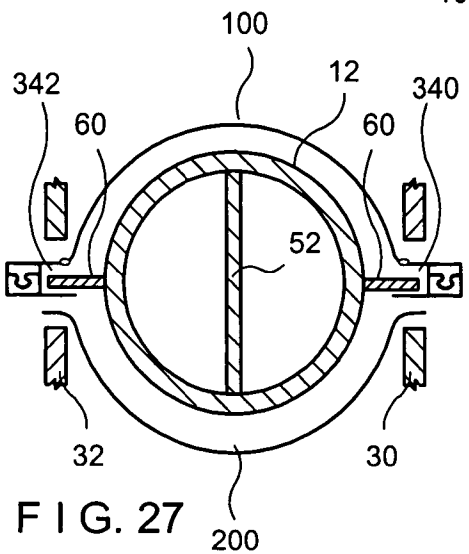
FIG. 27

VERTICAL FORM FILL AND SEAL METHOD FOR PRODUCING RECLOSABLE PACKAGES FROM TWO SHEETS OF WEB

BACKGROUND OF INVENTION

1. Field of the Invention

The present invention relates to a form fill and seal method and apparatus wherein two sheets of web are brought together at the fill tube and sealed to each other at their respective edges to form bags, typically reclosable plastic bags.

2. Description of the Prior Art

The prior art regarding form fill and seal methods and apparatus, including vertical form fill and seal method and apparatus, is well-established in the prior art. Some prior art in this area includes U.S. Pat. No. 6,178,722 entitled "Application system for Sliders at Form-Fill-Seal Machine" issued on Jan. 30, 2001 to McMahon; U.S. Pat. No. 4,894,975 entitled "Method and Apparatus for Making Reclosable Bags with Fastener Strips in a Form Fill and Seal Machine" issued on Jan. 23, 1990 to Steven Ausnit; U.S. Pat. No. 5,951,453 entitled "Reclosable Bag Assembly and Method of Making Same", issued on Sep. 14, 1999 to Yeager and U.S. Pat. No. 6,270,257 entitled "Reclosable Bag with Profile Strip Fastener Assembly Having Improved Opening Feature", issued on Aug. 7, 2001 to Yeager.

Additionally, horizontal form fill and seal methods and apparatus, wherein separate sheets are used for the top and bottom of a container, are disclosed in U.S. Pat. No. 6,138,439 entitled "Methods of Making Slide-Zippered Reclosable Packages on Horizontal Form-Fill-Seal Machines", issued on Oct. 31, 2000 to McMahon.

While this prior art has proven to be well-suited to the objectives of the industry, it is desired to further improve the methods and apparatus in this field.

It is always desirous to increase production rates and to reduce the complexities involved in the proper registration of the web in a high-speed device.

In particular, it is desired to reduce the angle of curvature imposed upon a single sheet of web as it is brought around the fill tube by the forming collar in vertical form fill and seal apparatus. This reduction in angle of curvature simplifies the proper registration of the web.

Additionally, in some applications, in may be desirous to form two bags simultaneously which increases production rates without increasing the linear speed at which a sheet of web is fed to the fill tube and the forming collar.

OBJECTS AND SUMMARY OF THE INVENTION

It is therefore an object of the present invention to simplify the registration of web in a form fill and seal apparatus.

It is therefore a further object of the present invention to reduce the angle of curvature imposed upon a single sheet of web as the web is wrapped around the fill tube by the forming collar.

It is therefore a still further object of the present invention to provide for an increased rate of production from a single fill tube of a vertical form fill and seal apparatus without requiring an increase in the linear speed of the web being fed to the fill tube and forming collar.

These and other objects are attained by a first embodiment of the present invention by providing a vertical form fill and seal apparatus and method wherein two sheets of web are fed to the fill tube, each along separate forming collars. One of the sheets includes transversely mounted reclosable zippers. Each sheet of web is brought around approximately 180 degrees of the periphery of the fill tube. The two sheets of web are sealed to each other at both edges, so that the two sheets typically form front and rear walls of a reclosable bag. These seals typically result in the side seals of the reclosable bag. A first transverse seal is formed below the fill tube so that product, such as foodstuffs, can be dispensed from the fill tube. A second transverse seal is then formed. Typically, the first transverse seal of a bag, along with the second transverse seal of a prior bag, are formed simultaneously by the same set of seal bars. A variation of the first embodiment provides the transverse zipper for the top of a bag immediately adjacent to the transversely mounted gusset for a bottom of a prior preceding bag.

In a second embodiment, two sheets of web are fed to a fill tube, each along separate forming collars, so that each sheet extends around approximately 180 degrees of the periphery of the fill tube. Likewise, two continuous lengths of zipper material are fed in the machine direction to the two locations where the longitudinal edges of two sheets are brought together. The profiles, or flanges, of the zippers are sealed to the longitudinal edges of the sheets of web. Therefore, the zippers are located 180 degrees apart in the resulting generally cylindrical shape surrounding the fill tube, with the sheets of web extending between the two zippers. Immediately under the bottom of the fill tube, sealing bars seal the midpoints of the two sheets of web to each other thereby forming side by side compartments. Alternately, the fill tubes and sealing bars between them could be offset from the center line to provide different size pouches and the sealing bars could also be used to create a peel seal between the pouches that at a later point in time would be ruptured in order to mix the materials in the heretofore separate pouches. A first transverse seal is formed immediately thereafter and contents, such as foodstuffs, is fed from the fill tube. Typically, the fill tube includes an internal lengthwise divider which assures that equal amounts of contents is directed to each side by side pouch. A second transverse seal, including a cut, is formed thereafter and the seal between the side by side pouches is cut thereby forming two pouches. Variations to the second embodiment can use zippers with or without sliders and could further include a peel seal inwardly adjacent from the zippers. Further variations to the second embodiment can form tamper evident shrouds over the zippers. A still further variation to either embodiment provides one of the sheets with the zippers attached thereto prior to feeding to the filling tube.

A third embodiment uses two side by side fill tubes with two sheets of web, wherein each sheet of web covers approximately 180 degrees of the periphery of each fill tube. Furthermore, two zippers are provided in the machine direction on the first sheet wherein the first profiles or flanges of the zippers are sealed immediately adjacent to the center line of the first sheet of web (a first zipper on one side of the center line, a second zipper on the second side of the center line). The second flanges or profiles of the zippers are then sealed to similar positions on the second sheet of web as the zippers pass between the fill tubes. A tamper evident shroud is thereby formed over each zipper. The longitudinal edges of the first sheet are sealed to the respective longitudinal edges of the second sheet at locations outward of each fill tube. Moreover, gussets can be formed at these seal locations.

A fourth embodiment uses a single fill tube and two sheets of web with a double zipper mounted in the transverse direction on the first sheet of web. Longitudinal seals are formed between the longitudinal edges of the two sheets of web. The longitudinal mid-points of the two sheets are sealed to each other near the bottom of the fill tube to create side by side compartments. The fill tube fills the side by side compartments. The necessary transverse seals and cuts are formed, as well as cutting the seal between the longitudinal mid-points of the two sheets to form separate compartments.

In these various embodiments, the use of two sheets permits using sheets with different physical characteristics, different transparencies, different colors, etc.

DESCRIPTION OF THE DRAWINGS

Further objects and advantages of the invention will become apparent from the following description and claims, and from the accompanying drawings, wherein:

FIG. 13 is a perspective view of the zipper, along with a gusset for a preceding bag, being transversely mounted or sealed to the web, in a variation of the first embodiment of the present invention.

FIG. 14 is a cross-sectional view along plane 14-14 of FIG. 13.

FIG. 15 is a plan view of the top or zippered end of a bag, adjacent to the bottom or gusseted end of a preceding bag resulting from the variation of the first embodiment illustrated in FIG. 13.

FIG. 16 is a cross-sectional view along plane 16-16 of FIG. 15, including the seal bars which seal the second sheet of web to the second flange of the zipper and to the gusset, and which cut successive bags from one another.

FIG. 17 is a cross-sectional view along plane 16-16 of FIG. 15, after the seal bars have sealed the second sheet of web to the second flange of the zipper and to the gusset, and after the successive bags have been cut from one another.

FIG. 18 is a cross-sectional view illustrating an additional gusset type seal.

FIG. 25 is a perspective view illustrating a second alternative of the second embodiment of the present invention, wherein the slider-operated zippers are attached to the longitudinal edges of the first sheet of web prior to feeding the sheet to the fill tube.

FIG. 26 is a cross-sectional view along plane 26-26 of FIG. 25, including the seal bars.

FIG. 27 is a cross-sectional view of the attaching the second sheet of web to the first sheet of web around the forming collar in the second alternative of the second embodiment of the present invention as illustrated in FIG. 25.

FIG. 28 is a cross-sectional view illustrating how the second alternative of the second embodiment of the present invention as illustrated in FIG. 25 can be further modified to include a separate shroud strip over the zipper.

FIG. 29 is a cross-sectional view illustrating how the second alternative of the second embodiment of the present invention as described in FIG. 25 can be still further modified to include a tamper evident shroud over the zipper.

FIG. 30 is a cross-sectional view of the first sheet of web and zipper in a yet still further modification of the second alternative of the second embodiment of the present invention as illustrated in FIG. 25, wherein a tamper evident shroud with tear lines is added over the zipper and a peel seal is added inwardly of the zipper.

DETAILED DESCRIPTION OF THE PREFERRED EMBODIMENTS

Figure 1:
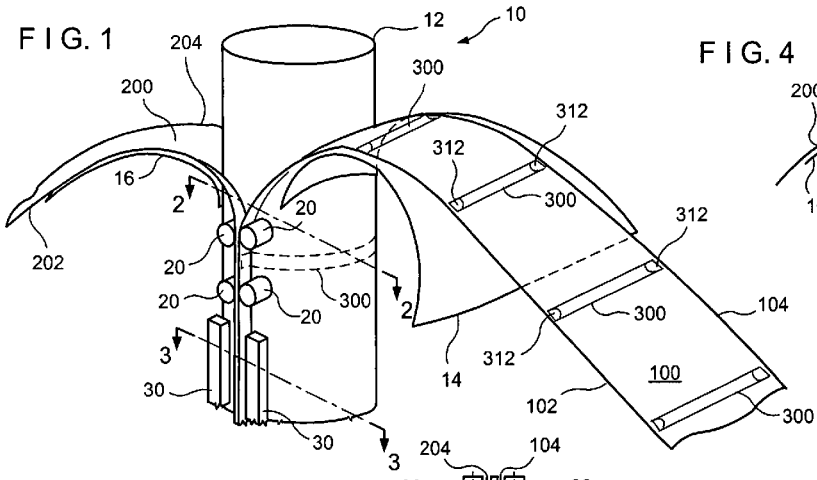
FIG. 1 is a perspective view of the first embodiment of the present invention, wherein two sheets of web are fed to the fill tube by forming collars, one of the sheets of web having zippers attached transversely thereto.
Figure 4:
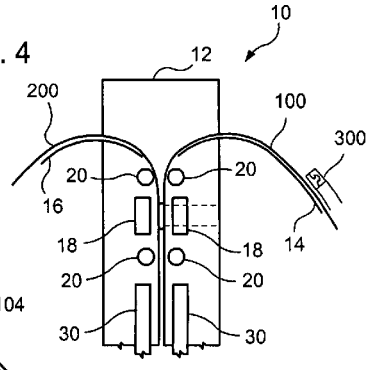
FIG. 4 is a further perspective view of the first embodiment of the present invention, showing the optional spot sealing bars adjacent to the fill tube.
Figure 5D:
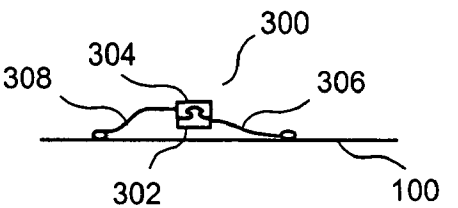
FIGS. 5A-5F are cross-sectional views of various zipper and flange combinations on the web, as can be used with the first embodiment of the present invention.
Figure 5E:
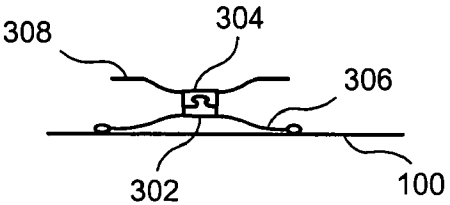
Figure 5F:
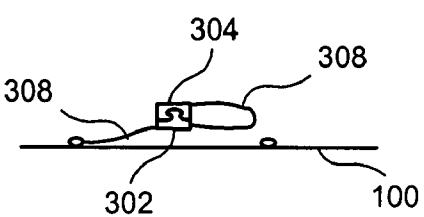
Figure 5A:
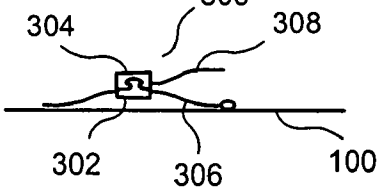
Figure 5B:
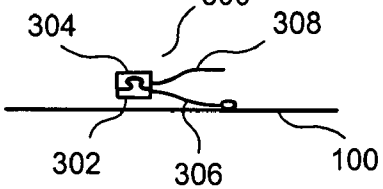
Figure 5C:
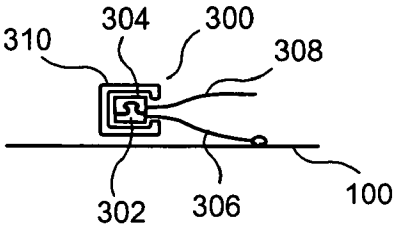
Figure 7:
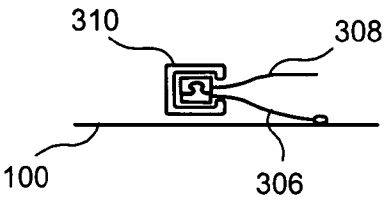
FIG. 7 is a cross-sectional view along plane 7-7 of FIG. 6, showing the slider zipper mounted transversely on the web.

Referring now to the drawings in detail wherein like numerals indicate like elements throughout the several views, one sees that FIG. 1 is a perspective view of form fill and seal apparatus 10 of the first embodiment of the present invention. As fill tube 12 is vertical, FIG. 1 is a perspective view of a vertical form fill and seal apparatus. First sheet 100 of web has first and second longitudinal edges 102, 104, and second sheet 200 of web has first and second longitudinal edges 202, 204. First sheet 100 of web further includes transversely mounted zippers 300 which are typically comprised of first and second interlocking profiles 302, 304. First and second interlocking profiles 302, 304 may include respective first and second flanges 306, 308 (see, for instance, FIGS. 5B, 5C, 7 and 9) or may be flangeless. Additionally, flanged zippers 300 may include sliders 310 (see, for instance, FIGS. 5C, 7 and 9). Zippers 300 may be sealed or spot sealed to first sheet 100 of web prior to first sheet 100 being wrapped around fill tube 12. FIG. 1 illustrates end seals 312 formed between the ends of zippers 300 and first sheet 100 of web. Alternatively, as shown in FIG. 4, zippers 300 may be end sealed to first sheet 100 of web by end sealing bars 18 after first and second sheets 100, 200 of web are wrapped around fill tube 12. A second set of end sealing bars 18 is positioned 180 degrees from the first set of end sealing bars illustrated in FIG. 4.

Figure 2:
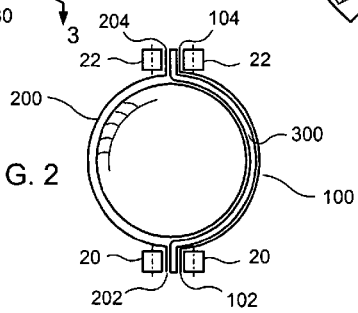
FIG. 2 is a cross-sectional view along plane 2-2 of FIG. 1.
Figure 3:
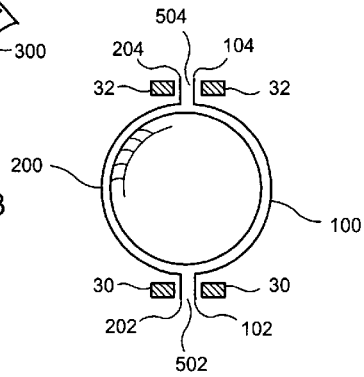
FIG. 3 is a cross-sectional view along plane 3-3 of FIG. 1.

As shown in FIGS. 1-3, first and second sheets 100, 200 of web are guided and wrapped around fill tube 12 by respective first and second forming collars 14, 16. First and second sheets 100, 200 are each wrapped around 180 degrees of the circumference of fill tube 12 so that first edge 102 of the first sheet 100 and first edge 202 of the second sheet are brought together and second edges 104, 204 of respective first and second sheets 100, 200 are brought together. First edges 102, 202 are held together and guided by guide rollers 20 while second edges are held together and guided by guide rollers 22. First longitudinal seal bars 30 seal first edges 102, 202 to each other thereby forming a first side seal 502 of the resultant bag 500 (see FIG. 5). Likewise, second longitudinal seal bars 32 seal second edges 104, 204 to each other thereby forming a second side seal 504 of the resultant bag 500.

Figure 5:
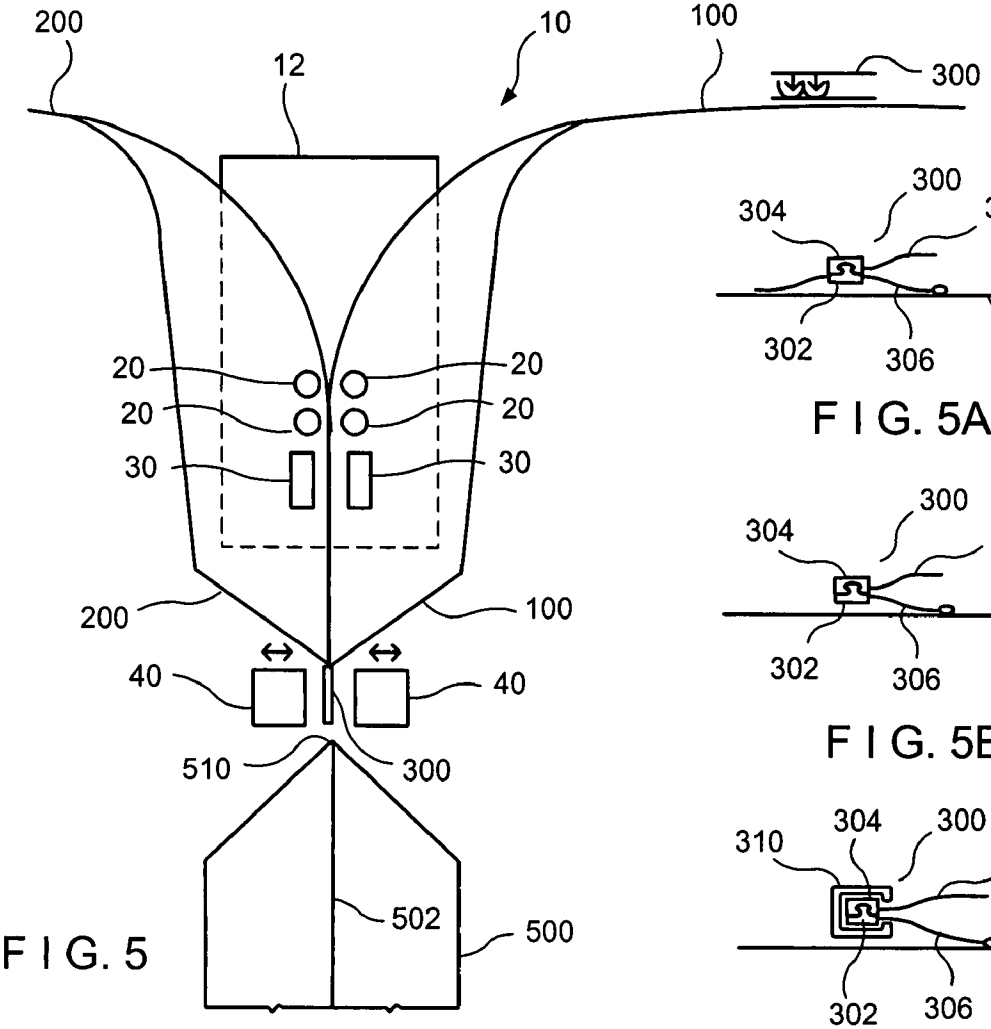
FIG. 5 is a plan view of the first embodiment of the present invention, showing the transverse seal bar and further showing an alternative zipper in cross-section.

Sheets 100, 200 thereby form a cylindrical shape. As shown in FIG. 5, transverse seal bars 40 seal second interlocking profile 304 or second flange 308 of zipper 300 to second sheet 200 of web and further, if necessary, complete the transverse sealing of first interlocking profile 302 or first flange 306 of zipper 300 to first sheet 100 of web. Simultaneously, transverse seal bars 40 form bottom transverse seal 510 of the preceding reclosable bag 500 and cuts preceding reclosable bag 500 from first and second sheets 100, 200 of web. Contents (not shown), such as foodstuffs, is dispensed from fill tube 12. Sheets 100, 200 of web are then advanced and the transverse sealing bar cycle repeats whereby transverse sealing bars 40 seal first sheet 100 to second sheet 200 thereby forming the bottom transverse seal 510 of the bag 500 as well as forming the top transverse seals between zipper 300 and the first and second sheets 100, 200 of web for the subsequent reclosable bag.

FIG. 5, as well as FIGS. 5A-5F, show various zipper configurations—slider zippers, sliderless zippers, string zippers, multiple track string zippers.

Further, as shown in FIGS. 6-12, the first embodiment of the present invention can be implemented with various cut-outs or lines of weakness in one or both sheets of web 100, 200. These implementations are particularly useful for slider zippers, but can also be used in some applications with sliderless zippers.

Figure 6:
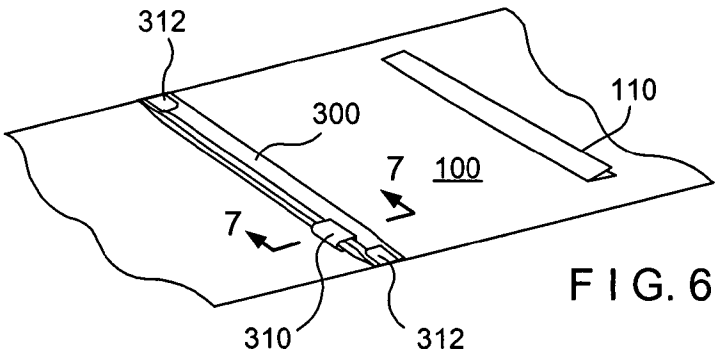
FIG. 6 is a perspective view of a slider zipper mounted transversely on the web, as can be used with the first embodiment of the present invention, and further illustrating a cut-out or perforated cut-out on the web over which the slider zipper is mounted.

FIG. 6 shows first sheet 100 of web with slider zipper 300 mounted transversely and secured thereto by transverse seal 320 and/or by end seals 312. Most applications will apply transverse seals between slider zipper 300 (such as first flange 306 in the embodiment shown in FIG. 7) and first sheet 100 of web. Additionally, cut-out 110 (which may be a full cut-out or a perforated cut-out) is illustrated in a subsequent position where the subsequent zipper 300 is applied. That is, zipper 300, as well as all zippers 300 on first sheet 100, has been applied over an identical cut-out 100. In the resulting bag, access to zipper 300 is provided through cut-out 110.

Figure 8:
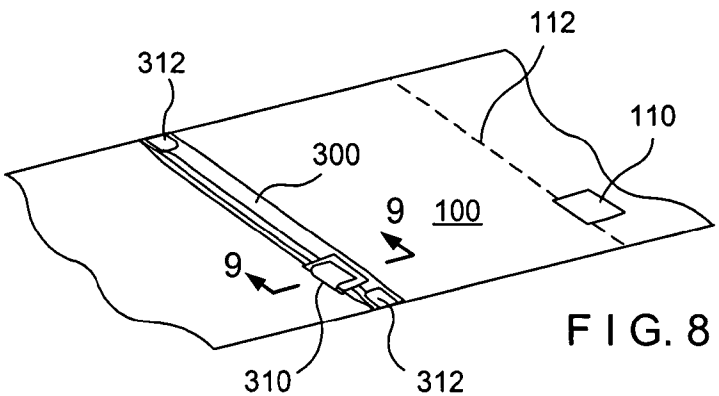
FIG. 8 is a perspective view of a slider zipper mounted transversely on the web, as can be used with the first embodiment of the present invention, and further including a form cut-out for the slider and a tear line.
Figure 9:
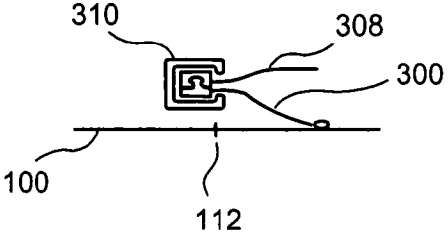
FIG. 9 is a cross-sectional view along plane 9-9 of FIG. 8, showing the slider zipper mounted on the web over the tear line, but not showing the cut-out.
Figure 10:
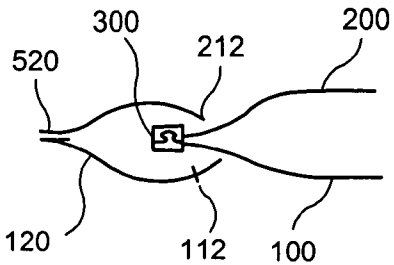
FIG. 10 is a cross-sectional view of the zipper configuration of the bag resulting from the structure shown in FIG. 9.

FIGS. 8, 9 and 10 show a similar configuration wherein cut-out 110 is sized for slider 310 to protrude therethrough in a parked configuration in order to form a tear-away header 120. A line of weakness 112 is provided in sheet 100 and a similar line of weakness 212 is provided in second sheet 200 as well as a top cross seal 520, cross sealing sheets 100, 200 together (see FIG. 10). Such a header may or may not have slider sized cut outs.

Figure 11:
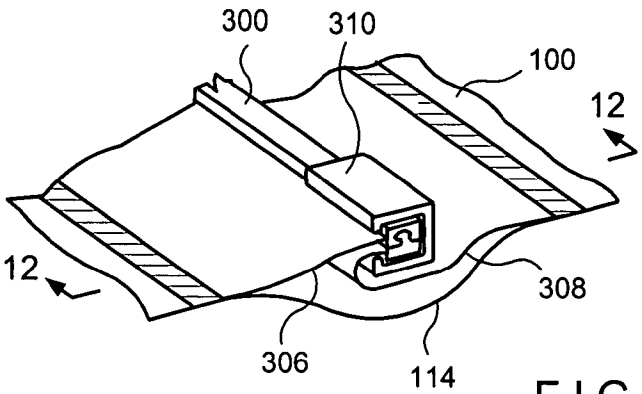
FIG. 11 is a perspective view of a slider zipper mounted transversely on the web, as can be used with the first embodiment of the present invention, wherein both flanges of the zipper are mounted on the front sheet of web.
Figure 12:
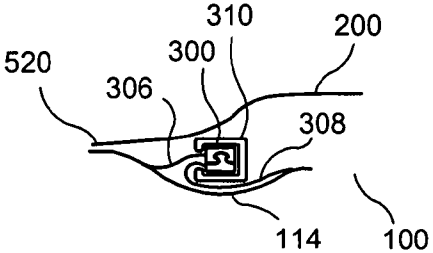
FIG. 12 is a cross-sectional view along plane 12-12 of FIG. 11.

FIGS. 11 and 12 show another similar configuration wherein both zipper flanges 306, 308 are sealed to the first sheet 100 of web and access to zipper 300 and slider 310 is provided through a tear away panel 114, similar to a perforated cut-out.

FIGS. 13-17 illustrate a variation in the first embodiment of the present invention wherein a U-shaped gusset 530 is provided to the bottom of the reclosable bag 500. As shown in FIG. 13, drive rollers 42 drive a combination of zipper 300 and U-shaped gusset 530 to a transverse location across first sheet 100 of web. For a given combination, U-shaped gusset 530 is sealed to a bag preceding the bag to which zipper 300 is sealed. Transverse seal bars 44, 46 seal a first end 532 of U-shaped gusset 530 and first flange 306 of zipper 300, respectively, to first sheet 100 of web. Guide bar 48 must retract to allow the sealed zipper to pass by. Typically, guide bar 46 will not retract. Retractable guide bar 48 prevents the sealing of the second end of U-shaped gusset 530 and further provides a solid surface against which transverse sealing bar 44 can urge. Likewise, guide bar 50 prevents the sealing of second flange 308 and provides a solid surface against which transverse seal bar 46 can urge.

Apparatus similar or identical to that shown in FIG. 1 is then used to form the cylindrical shape of the bag 500 and to fill the bag 500.

Thereafter, as shown in FIGS. 15-17, transverse sealing bars 40 forms a transverse seal between second sheet 200 and second flange 308, forms transverse seal 520 between first and second sheets 100, 200, cuts the successive bags from one another and form a transverse seal between second end 534 of U-shaped gusset 530.

As shown in FIG. 18, an additional gusset seal can be provided by diagonal edge seal 540 impinging upon the inverted bottom of the bag 500.

Figure 20:
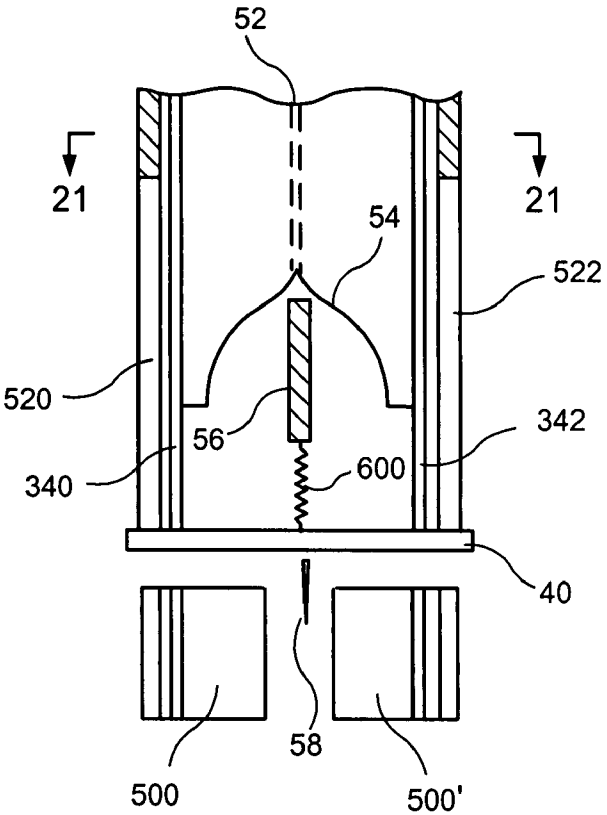
FIG. 20 is a plan view of an alternative to the second embodiment of the present invention, wherein the flangeless zippers are sealed inwardly of the sheet edges and the sheet edges are sealed outwardly of the zippers to form shrouds above the zippers
Figure 21:
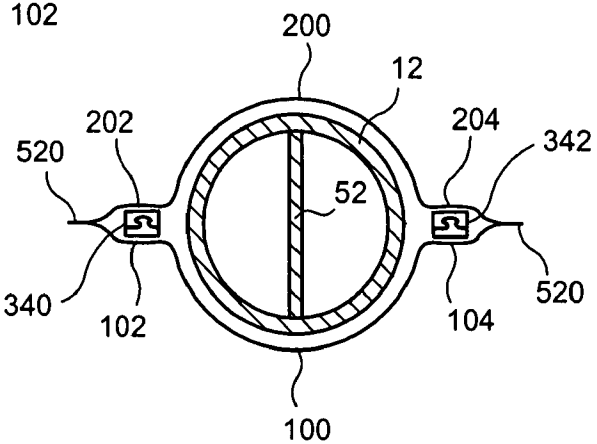
FIG. 21 is a cross-sectional view along plane 21-21 of FIG. 20.
Figure 19:
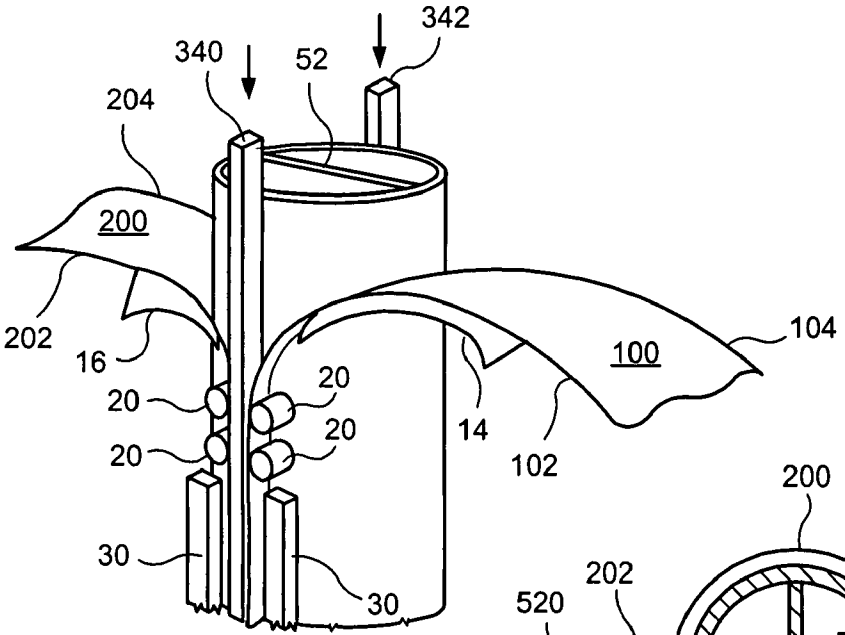
FIG. 19 is a perspective view of the second embodiment of the present invention, wherein two sheets of web are fed to a fill tube by forming collars, and wherein two continuous lengths of flangeless zipper are guided in the machine direction between the longitudinal edges of the sheets of web.

FIGS. 19-30 illustrate a second embodiment of the present invention, wherein side by side bags are formed with a single fill tube. FIG. 19 is a perspective view of first and second sheets 100, 200 of web being brought to fill tube 12 by forming collars 14, 16 in much the way that is done in FIG. 1. However, first continuous length of zipper 340 (shown in FIG. 21 as a flangeless zipper and in FIGS. 22 and 23 as a flange type zipper) is fed in a machine direction between edges 102, 202. Likewise, second continuous length of zipper 342 is fed in a machine direction between edges 104, 204. First and second continuous lengths of zipper 340, 342 are illustrated without sliders, but sliders could be incorporated into this embodiment. Alternately, the slider could be mounted onto the zippers after the zippers have been sealed to the sheet edges. The guide rollers 20, 22 of the second embodiment function similarly to those of the first embodiment. However, the edges of the sheets of web as well as lengths of zipper are drawn therethrough. Similarly, longitudinal sealing bars 30, 32 function to seal a first profile or flange of first continuous length of zipper 340 to first edge 102 of first sheet 100 of web, a second profile or flange of first continuous length of zipper 340 to first edge 202 of second sheet 200 of web, a first profile or flange of second continuous length of zipper 342 to second edge 104 of first sheet 100 of web, and a second profile or flange of second continuous length of zipper 342 to second edge 204 of second sheet 200 of web. Additionally, as shown in FIG. 21, first edges 102, 202 can be sealed together and second edges 104, 204 can be sealed together over zippers 340, 342, respectively to form shrouds over the zippers 340, 342.

As shown in FIGS. 19-21, fill tube 12 is bisected by divider 52 in order to equally divide the contents between the two side by side pouches or bags which are formed in this embodiment. Additionally, as shown in FIG. 20, the bottom of fill tube 12 includes opposed notches 54 so that seal bars 56 can seal the center lines of sheets 100, 200 of web together so as to form a machine direction seal 600 which will define the two horizontally adjacent reclosable bags and, after these bags are filled and separated, form bottom seals thereof. Transverse sealing bars 40 perform the usual functions of forming transverse seals and cutting the completed bags away from the subsequent bags. However, in this embodiment, transverse sealing bars 40 further include machine direction cutting bars 58 to separate the horizontally adjacent packages 500 and 500' as shown in FIG. 20.

Figure 24:
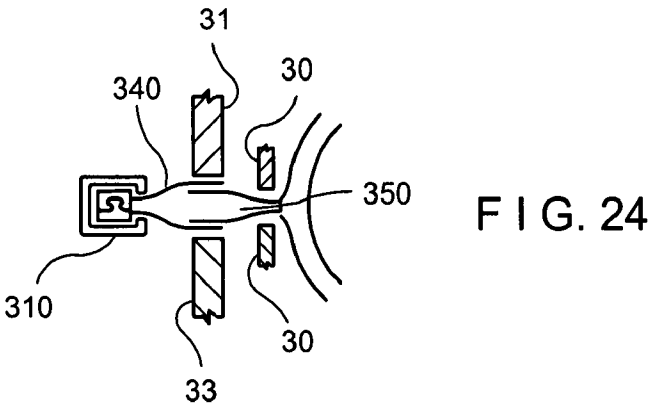
FIG. 24 is a cross-sectional view illustrating a second alternative of the second embodiment of the present invention wherein a peel seal is formed inward of the slider zipper, in lieu of a shroud over the slider zipper.
Figure 23:
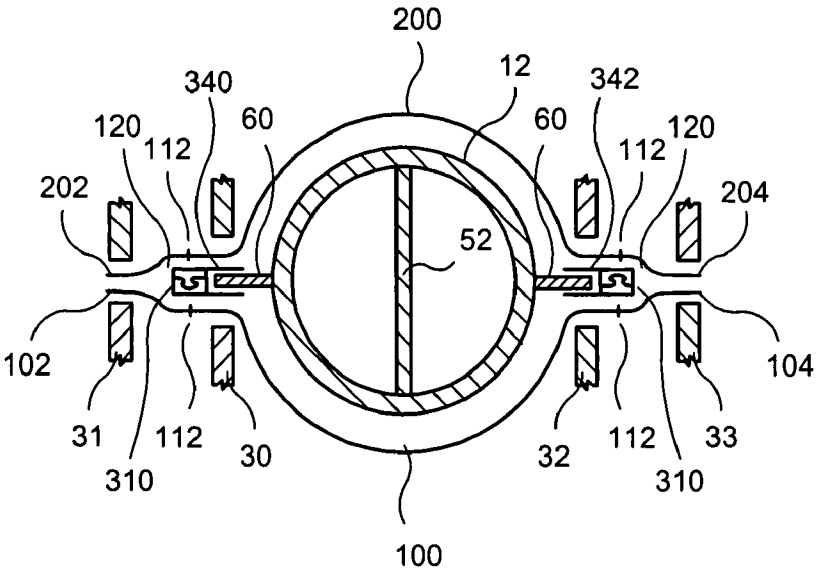
FIG. 23 is a cross-sectional view along plane 23-23 of FIG. 22.
Figure 22:
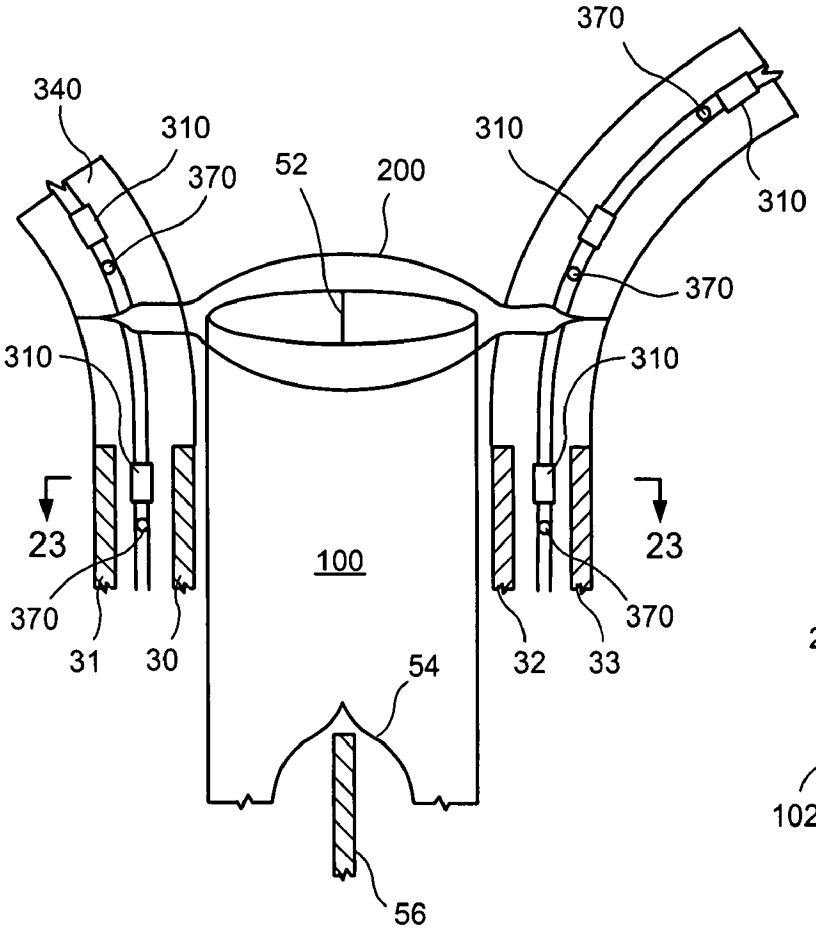
FIG. 22 is a perspective view of a first alternative of the second embodiment of the present invention, wherein shrouds are formed over two continuous lengths of slider-operated zippers which are guided between the longitudinal edges of the sheets of web.
Figure 34:
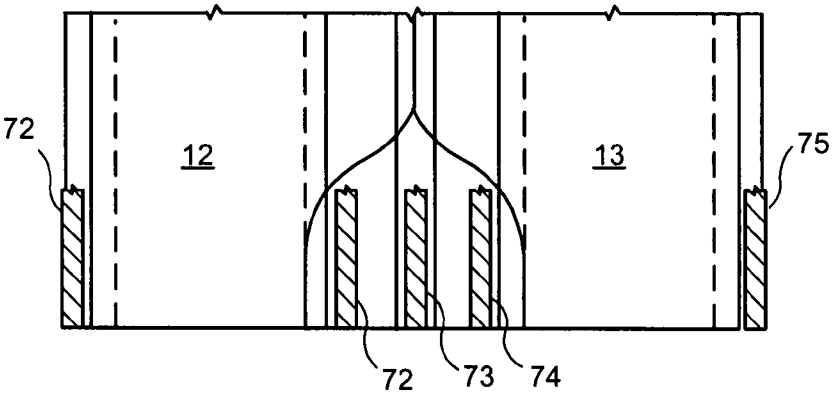
FIG. 34 is a plan view of the third embodiment of the present invention, wherein two zippers are provided near the center line of the first sheet and the first and second sheets are fed to a double fill tube configuration for the side by side production of reclosable bags.
Figure 35:
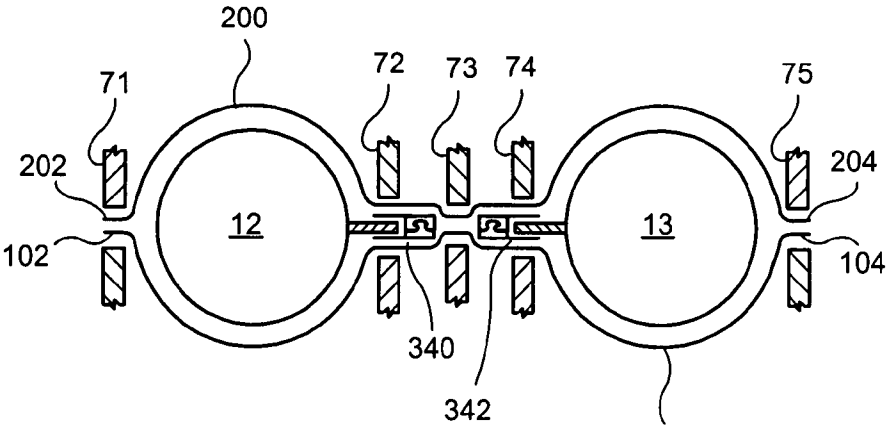
FIG. 35 is a cross-sectional view along plane 35-35 of FIG. 34.

FIGS. 22-24 disclose a first alternative of the second embodiment wherein first and second longitudinal seal bars 30, 32 are supplemented by first and second outer longitudinal seal bars 31, 33. Furthermore, first and second continuous lengths of zipper 340, 342 are illustrated with sliders 310 and end seals 370 when required longitudinal seal bars 30, 32 seal the flanges of first and second continuous lengths of zipper 340, 342, respectively, to the appropriate edges of sheets 100, 200 of web. Separators 60 extend radially from fill tube 12 to prevent the flanges of first and second continuous lengths of zipper 340, 342 from being sealed to each other by longitudinal seal bars 30, 32. First outer longitudinal seal bars 31 seal first edges 102, 202 together to form a shroud over the zipper 340 and, likewise, second outer longitudinal seal bars 33 seal second edges 104, 204 together to form a shroud over the zipper 342. Lines of weakness 112 are typically formed in the sheets 100, 200 of web so that the shrouds become tamper-evident tear-away headers 120.

Alternatively, as shown in FIG. 24, outer longitudinal seal bars 31 (and 33) can seal the flanges of the zipper 340 (and 342) to the edges of the sheets of web while longitudinal seal bars 30 (and 32) form peal seals 350 inwardly of the zipper.

FIGS. 25-30 illustrate a second alternative for the second embodiment of the present invention. In this alternative, the first profiles or flanges of continuous lengths of zipper 340, 342 are sealed to the edges of first sheet 100 of web (i.e., in the machine direction) by sealing bars 600 (see FIG. 26) prior to being provided to the form fill and seal apparatus 10. Continuous lengths of zipper 340, 342 can include many variations of zippers, including those with or without sliders 310. Longitudinal sealing bars 30, 32 seal the second profile 304 or flange 308 of continuous lengths of zipper 340, 342 to second sheet 200 of web. As shown in FIG. 27, separator 60 can be used to prevent seal through between the profiles or flanges.

As shown in FIG. 28, a separate sheet 344 can additionally be sealed by longitudinal sealing bars 30 over continuous length of zipper 342 (as well as a second separate sheet for zipper 340) in order to form a shroud over the zippers.

FIG. 29 illustrates how in this alternative, similar to that shown in FIG. 23, an outer longitudinal seal bar 33 (and 31) can be used to form a shroud over the zipper. However, in this instance, the zipper flanges, instead of being sealed to the edges of the sheet 100, are sealed at a distance from the edges, as shown in FIG. 30, so as to allow enough film beyond the zippers to form the shrouds.

FIG. 30 further illustrates how lines of weakness 112 and peel seals 350 can be pre-formed on sheet 100 of web prior to being supplied to the forming collars 14, 16 and fill tube 12.

Figure 31:
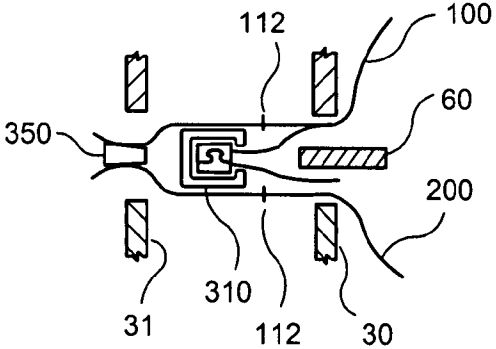
FIG. 31 is a cross-sectional view illustrating the sealing of the second sheet of web to the zipper in the yet still further modification of the second alternative of the second embodiment of the present invention as illustrated in FIG. 25, including a peel seal above the zipper.

FIG. 31 illustrates outer longitudinal seal bar 31 forming a peel seal 350 at the top of a tear-away header 120 with lines of weakness 112, as well as a tab created by a cut out where the tab is not removed and acts as a pull tab to help remove the shroud.

Figure 32:
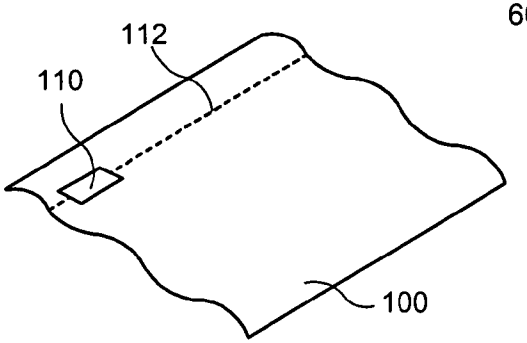
FIG. 32 is a plan view of the web of the yet still further modification of the second alternative of the second embodiment of the present invention wherein a slider window or cut-out is added to the web.

FIG. 32 illustrates a cut-out 110, for parking a slider, and a longitudinal line of weakness 112, for creating a tear-away header 120, on first sheet 100 of web for use in the second embodiment of the present invention.

Figure 33:
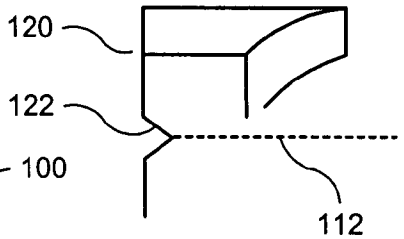
FIG. 33 is the detail of the upper left hand corner of a bag with a tamper evident shroud, such as would be made in accordance with FIGS. 30 and 31, wherein a notch is added to the end of the tear line and the tab created by the cut out, where the tab is not moved and acts as a pull tab to help remove the shroud.

FIG. 33 illustrates that a line of weakness 112 on a tear-away header 120 typically includes a notch 122 formed on at least one end thereof to direct the user's force to tear along the line of weakness 112 and can also include tab 115 formed from the film strip of the cut-out, wherein the tab acts as a pull tab.

Figure 36:
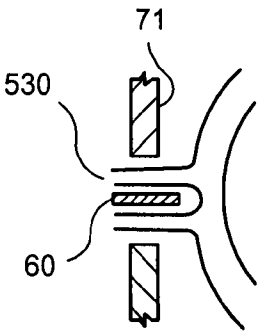
FIG. 36 is a cross-sectional view of the sealing of the longitudinal edges in a variation of the third embodiment, wherein a gusset strip is sealed between the longitudinal edges of the first and second sheets.
Figure 37:
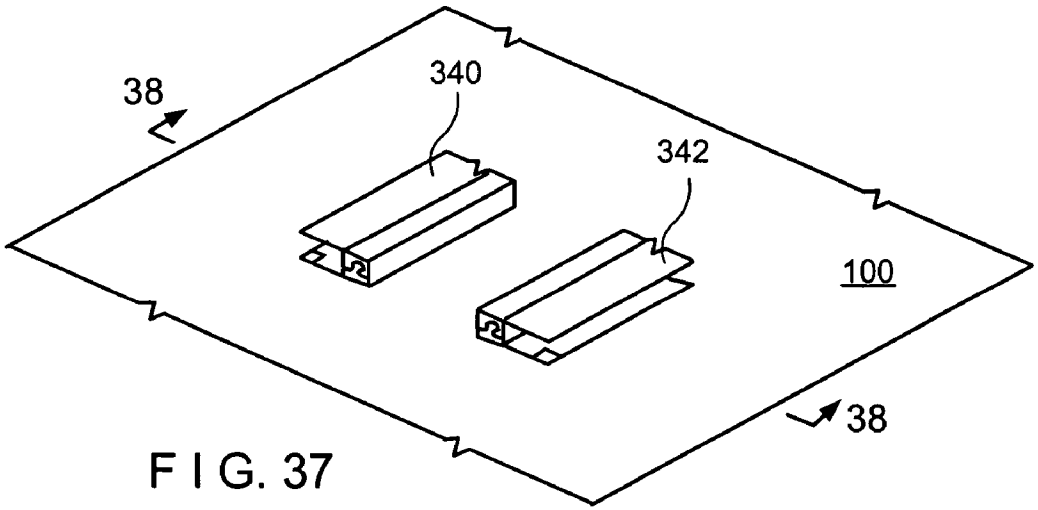
FIG. 37 is a plan view of the first sheet of web used in a third embodiment of the present invention.
Figure 38:
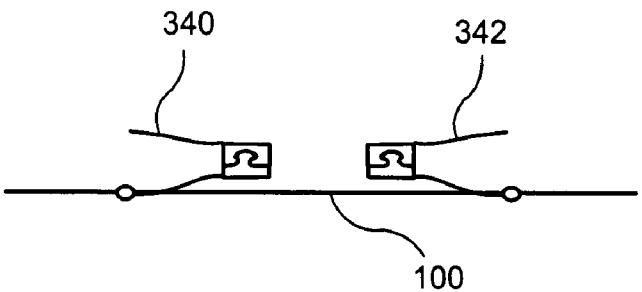
FIG. 38 is a cross-sectional view along plane 38-38 of FIG. 37.

FIGS. 34-40 illustrate a third embodiment of the present invention wherein first and second fill tubes 12, 13 are provided side by side and first sheet 100 of web is provided with the first profiles or flanges of two continuous strips of zipper 340, 342 sealed near a center line thereof (see FIGS. 37 and 38). First sheet 100 of web is guided around a first side of first and second fill tube 12, 13 while second sheet 200 of web is guided around a second side of the first and second fill tubes 12, 13. In this configuration, continuous lengths of zipper 340, 342 are positioned between fill tubes 12, 13 and first edges 102, 202 are brought together at an outward side of fill tube 12 and sealed together by first longitudinal seal bar 71 while second edges 104, 204 are brought together at an outward side of fill tube 13 and sealed together by fifth longitudinal seal bar 75. Simultaneously, second longitudinal seal bar 72 seals the second profile or flange of zipper 340 to a first side adjacent to the center line of second sheet 200 of web, fourth longitudinal seal bar 74 seals the second profile or flange of zipper 342 to a second side adjacent to the center line of second sheet 200 of web, and third longitudinal seal bar 73 seals the center line of first sheet 100 of web to the center line of second sheet 200 of web thereby forming shrouds over zippers 340, 342. The resulting side by side bags are then appropriately filled, cross sealed and cut.

FIG. 36 discloses how first longitudinal seal bar 71 (as well as fifth longitudinal seal bar 75) can form a U-shaped gusset 530 on what will be the bottom of the resulting bags when a U-shaped strip is introduced between the edges of first and second sheets 100, 200.

Figure 39:
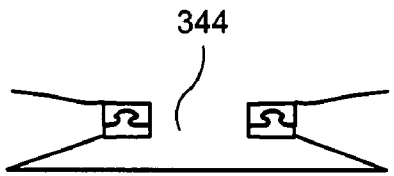
FIG. 39 is a cross-sectional view of a one-piece double zipper configuration which can be substituted for the two zippers shown in FIGS. 37 and 38 in the third embodiment of the present invention.

FIG. 39 illustrates how a double zipper configuration 344 could be substituted for zippers 340, 342.

Figure 40:
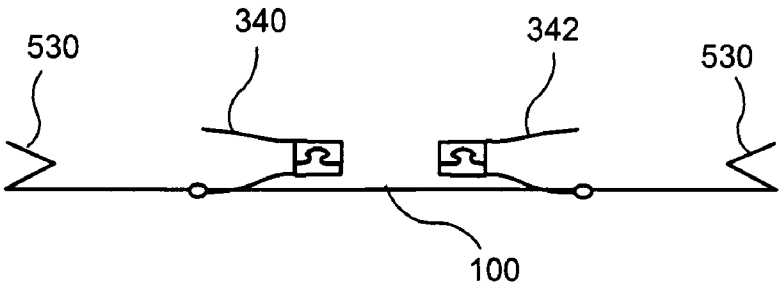
FIG. 40 is a variation of FIG. 38, wherein gussets are provided at the longitudinal edges of the first sheet of web, as used in the third embodiment of the present invention.

FIG. 40 illustrates how U-shaped gussets 530 can be provided at edges 102, 104 of first sheet 100 of web prior to providing first sheet 100 to the forming collars 14, 16 or fill tubes 12, 13.

Figure 42:
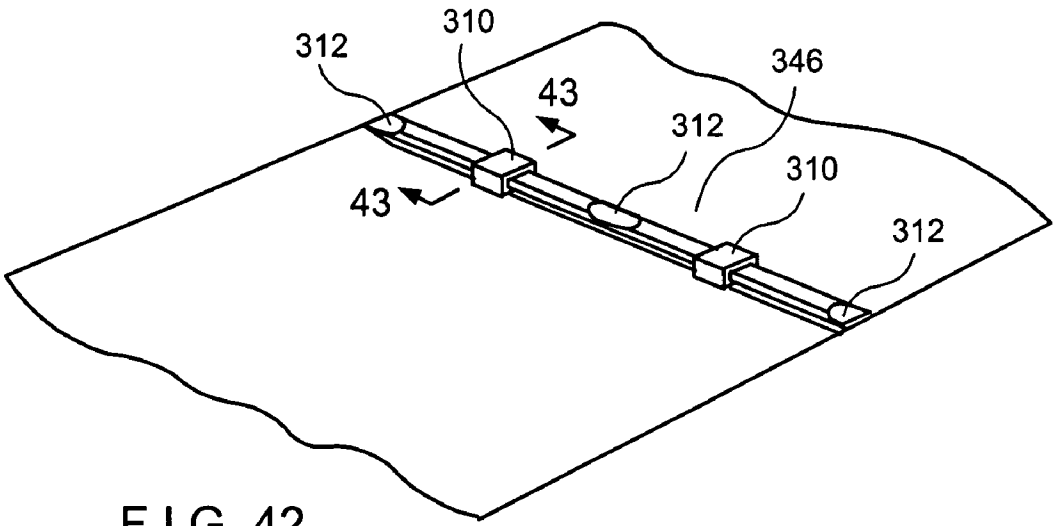
FIG. 42 is a perspective view of the first sheet of web used in the fourth embodiment of the present invention, shown with a double zipper mounted transversely to the first sheet of web.
Figure 43:
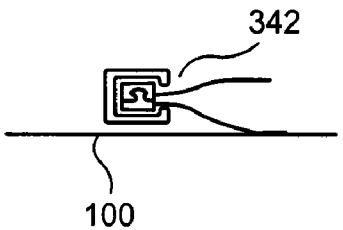
FIG. 43 is a cross-sectional view along plane 43-43 of FIG. 42.
Figure 41:
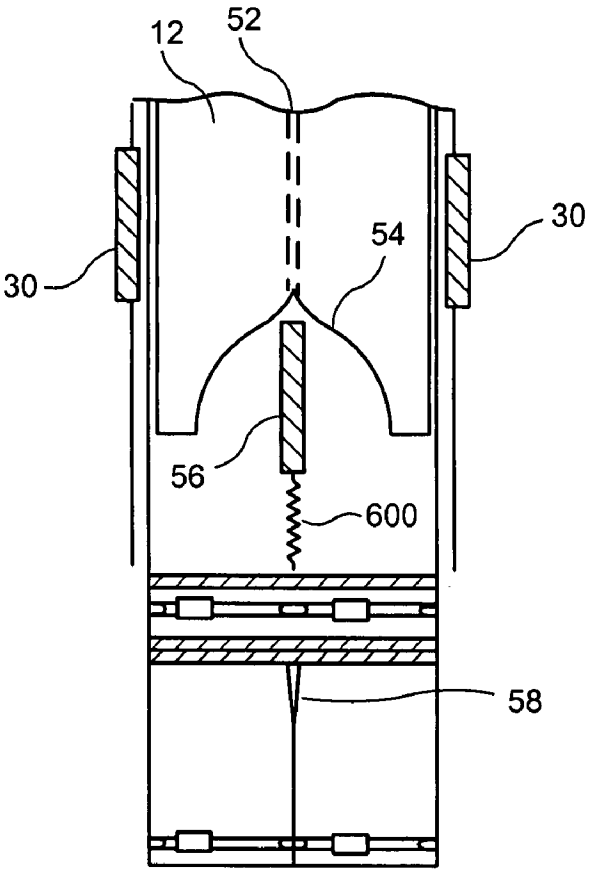
FIG. 41 is a plan view of a fourth embodiment of the present invention, wherein a double zipper is mounted transversely on the first sheet of web, and first and second sheets of web are fed to the fill tube for the side by side production of reclosable bags.

FIGS. 41-43 illustrate a fourth embodiment of the present invention wherein first sheet 100 of web is provided with a double zipper 346 which is transversely mounted on the first sheet 100 of web. Similar to the embodiment shown in FIGS. 19-21, divider 52 is provided in fill tube 12 to provide for the even distribution of contents between the two side by side bags. The bottom of fill tube 12 includes opposed notches 54 so that seal bars 56 can seal the center lines of sheets 100, 200 of web together so as to form a machine direction seal 600 which will define the two horizontally adjacent reclosable bags and, after these bags are filled and separated, form side seals thereof. Likewise, transverse seal bars 40 (not shown in FIGS. 41-43, see FIG. 20) include machine direction cutting bars 58 to separate the side by side packages.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method for making bags comprising the steps of:

providing a first sheet of web with a first longitudinal edge and a second longitudinal edge;

providing a second sheet of web with a first longitudinal edge and a second longitudinal edge;

providing at least one zipper, said zipper including a first interlocking profile and a second interlocking profile, wherein said first interlocking profile is sealed to substantially an entire width of said first sheet of web in a transverse orientation;

wrapping said first and second sheets of web around a filling station whereby said first longitudinal edges are joined and second longitudinal edges are joined;

sealing said first longitudinal edges to each other;

sealing said second longitudinal edges to each other; and sealing said second interlocking profile to said second sheet of web.

2. The method of claim 1 further including the step of guiding said first and second sheets of web by first and second forming collars, respectively.

3. The method of claim 2 wherein said first and second sheets of web are each guided around substantially 180 degrees thereby forming a generally cylindrical shape.

4. The method of claim 3 wherein said filling station is a fill tube and wherein first and second sheets of web are guided around said fill tube so that each of said first and second sheets of web extends around substantially 180 degrees of a periphery of said fill tube.

5. The method of claim 4 wherein said method is a form fill and seal method.

6. The method of claim 4 wherein said fill tube is vertical and said method is a vertical form fill and seal method.

7. The method of claim 1 wherein said step of sealing said second interlocking profile to said second sheet of web is performed after said steps of sealing said first and second longitudinal edges.

8. The method of claim 7 further including the step of forming a transverse seal adjacent to said zipper between said first and second sheets of web thereby forming a shroud over said zipper.

9. The method of claim 1 wherein said at least one zipper includes a slider.

10. The method of claim 1 wherein said interlocking profiles are free of flanges.

11. The method of claim 1 wherein said interlocking profiles include flanges.

12. A method for making bags comprising the steps of:

providing a first sheet of web with a first longitudinal edge and a second longitudinal edge;

providing a second sheet of web with a first longitudinal edge and a second longitudinal edge;

providing at least one zipper, said zipper including a first interlocking profile and a second interlocking profile, wherein said first interlocking profile is sealed to said first sheet of web in a transverse orientation;

wrapping said first and second sheets of web around a filling station whereby said first longitudinal edges are joined and second longitudinal edges are joined;

sealing said first longitudinal edges to each other;

sealing said second longitudinal edges to each other;

sealing said second interlocking profile to said second sheet of web; and wherein said first sheet of web includes an aperture which is spanned by said zipper.

13. The method of claim 12 wherein said at least one zipper includes a slider and wherein said aperture is positioned over said slider.

14. The method of claim 13 wherein said first sheet of web further includes a line of weakness joining said aperture to edges of said first sheet of web.

15. A method for making bags comprising the steps of:

providing a first sheet of web with a first longitudinal edge and a second longitudinal edge;

providing a second sheet of web with a first longitudinal edge and a second longitudinal edge;

providing at least one zipper, said zipper including a first interlocking profile and a second interlocking profile, wherein said first interlocking profile is sealed to said first sheet of web in a transverse orientation;

wrapping said first and second sheets of web around a filling station whereby said first longitudinal edges are joined and second longitudinal edges are joined;

sealing said first longitudinal edges to each other;

sealing said second longitudinal edges to each other;

sealing said second interlocking profile to said second sheet of web; and sealing a transverse gusset to said first sheet of web immediately adjacent to said zipper, wherein said gusset is formed with a bag preceding a bag in which said zipper is formed.

16. A method for making bags comprising the steps of:

providing a first sheet of web with a first longitudinal edge and a second longitudinal edge;

providing a second sheet of web with a first longitudinal edge and a second longitudinal edge;

providing at least one zipper, said zipper including a first interlocking profile and a second interlocking profile, wherein said first and second interlocking profiles are sealed to substantially an entire width of said first sheet of web in a transverse orientation;

wrapping said first and second sheets of web around a filling station whereby said first longitudinal edges are joined and second longitudinal edges are joined;

sealing said first longitudinal edges to each other; and sealing said second longitudinal edges to each other.

17. The method of claim 16 wherein said zipper includes a slider.

18. The method of claim 16 wherein said zipper is free of a slider.

19. The method of claim 16 wherein, in said wrapping step, said first sheet of web is wrapped around said fill tube approximately 180 degrees and said second sheet of web is wrapped around said fill tube approximately 180 degrees.

20. The method of claim 16 wherein said first sheet of web has a width substantially equal to said second sheet of web.

* * * * *